US005836093A

United States Patent [19]

Gallay

[11] Patent Number: 5,836,093

[45] Date of Patent: Nov. 17, 1998

[54] BINDING FOR RETAINING A SHOE OR BOOT TO A SNOW SHOE

[76] Inventor: Philippe Gallay, Le Nojak, 74220 La Clusaz, France

[21] Appl. No.: 788,022

[22] Filed: Jan. 24, 1997

[30] Foreign Application Priority Data

Jan. 26, 1996 [FR] France ..... 96 01200
Jul. 3, 1996 [FR] France ..... 96 08558

[51] Int. Cl.[6] ..... A43B 5/04
[52] U.S. Cl. ..... 36/125
[58] Field of Search ..... 36/122–125

[56] References Cited

U.S. PATENT DOCUMENTS

| | | | |
|---|---|---|---|
| 3,724,866 | 4/1973 | Kaplan | 280/11.13 W |
| 4,259,793 | 4/1981 | Morgan, Jr. et al. | 36/125 |
| 4,271,609 | 6/1981 | Merrifield | 36/125 |
| 5,517,772 | 5/1996 | Anderson | 36/125 X |
| 5,659,981 | 8/1997 | Liautaud | 36/125 X |

FOREIGN PATENT DOCUMENTS

| | | |
|---|---|---|
| 671 190 A1 | 9/1995 | European Pat. Off. . |
| 705 625 A1 | 9/1995 | European Pat. Off. . |
| 410500 | 5/1910 | France . |
| WO 95/33534 | 12/1995 | WIPO . |

*Primary Examiner*—B Dayoan
*Attorney, Agent, or Firm*—Fay, Sharpe, Beall, Fagan, Minnich & McKee

[57] ABSTRACT

A binding (5) for a snow shoe (1) includes a front binding portion (9). The front binding portion (9) includes a base plate (11) from which a pair of side walls (9*a,* 9*b*) extend upward. The side walls have upward extensions (13*a,* 13*b*) which have transverse slots (14) defined therein. Upper wall portions or straps (10*a,* 10*b*) have detents (16) which are slidably received in the slots. A heel engaging loop (21) is connected with cables (18*a,* 18*b*) which engage the top wall portions or the detents. As the loop is pulled over the heel of the boots, the cables pull the detents downward through the slots, drawing the side walls together, contracting a cavity (15) which they define tightly around the toe of the boot.

11 Claims, 7 Drawing Sheets

FIG 7a
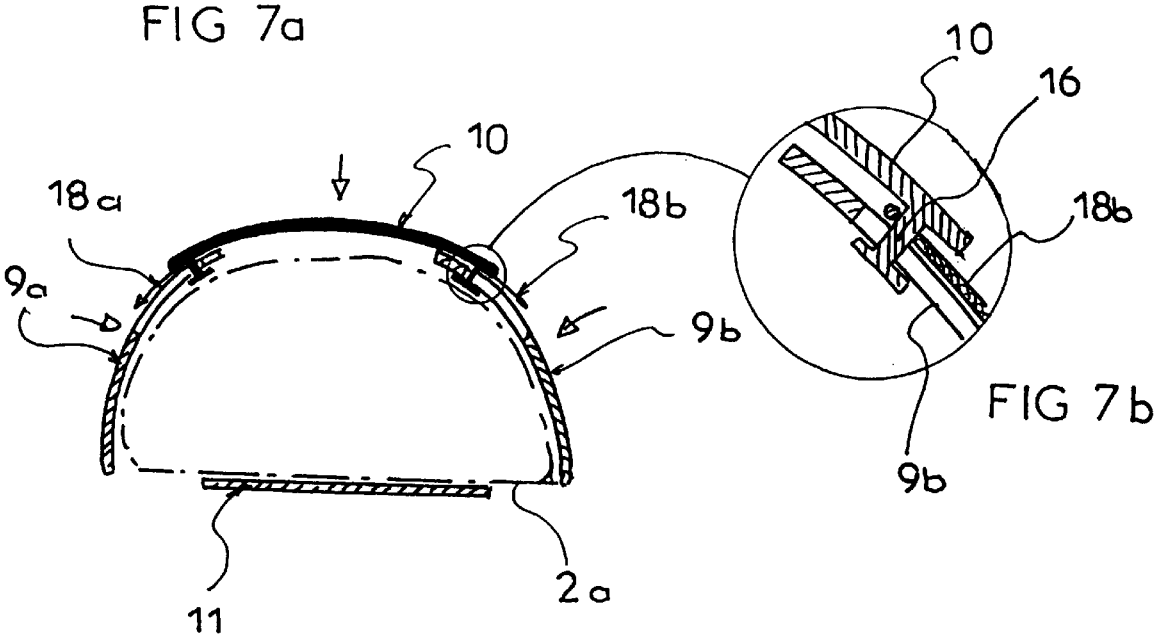
FIG 7b
FIG 7c
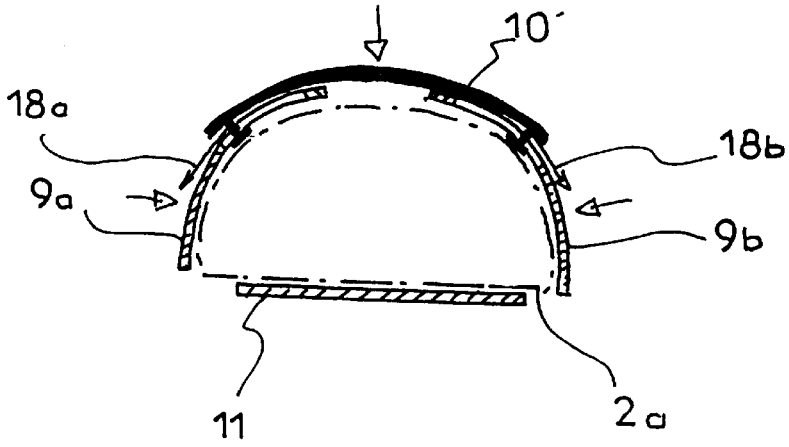

BINDING FOR RETAINING A SHOE OR BOOT TO A SNOW SHOE

BACKGROUND OF THE INVENTION

The present application relates to snow shoes and, more specifically, to bindings for holding the shoe or boot on the snow shoe.

Snow shoes are instruments which have been known for a great many years. They have been utilized for several centuries by the Scandinavian populations for travelling to permit the population or the mountain troops to move on snow for travels required by their daily life. At the present, snow shoes are also utilized by walkers or athletic persons for their runs and hikes and even for competitive events.

Various devices already exist for retaining shoes on a snow shoe. In particular, two kinds are known, one which is called a plate and one which is called a rubber boot. Generally, the plate-type devices are most often utilized by athletes concerned about performance, since the retention of the foot is assured with more firmness. The rubber boot-type devices are made up of a front enclosure, realized by a rubber casing in which the front extremity of the shoe is retained. The interior wall of the enclosure destined to receive said front extremity is soft and pliable which results in the possibility of rotating the shoe around a point located below the front of the foot causing lateral displacement of the heel. Retention of the shoe is thus not well assured. But even though this latter type of retention is preferred by hikers with lower requirements than the athletes concerned with performance, these hikers, nevertheless, desire also to have their shoes held securely.

The present invention proposes to resolve the drawbacks of the known devices by suggesting a device which combines simplicity, convenience, safety, and reliability.

SUMMARY OF THE INVENTION

The retention device of a shoe or boot on a snow shoe according to the invention is characterized in that the front retention means comprises a group of holding walls forming an enclosure or cavity, open toward the rear, and which is intended to engage the front extremity of the shoe. The rear extremity of said shoe is retained by rear retention means which causes the cavity or enclosure to close on and/or around the shoe.

According to another feature, the front retention means are constituted in part by a lower plate of sole plate, at least two lateral holding walls, and an upper connection means.

According to a specific embodiment, the front retention means comprise a front stop wall, in front of which the lateral holding walls are articulated with slightly vertical axes.

According to another specific embodiment, the lateral holding walls are articulated in relationship to the sole plate. The articulation is contained in a horizontal plane.

According to another characteristic, the upper connection means are made up by at least one upper support wall, firmly attached to the lateral holding walls and mounted in sliding fashion relative to at least one of said lateral walls.

In a specific embodiment, the lateral holding walls each possess at least one upper wall extension, fitted with a transverse hole. The extensions are symmetrically arranged on all sides of the front extremity of the shoe. The upper support wall(s) is mounted in sliding fashion between two symmetrical extensions through the intermediary of serrated teeth, arranged close to its (their) extremities, in a manner so as to let said extensions slide in the transverse holes.

Furthermore, the upper support wall(s) has (have) a rounded shape, open in downward direction. The upper support wall(s) permit, thanks to its (their) sliding capacity in downward direction relative to the lateral holding walls, lateral pulling of one toward the other. The lateral holding walls thus cause the closing of the cavity.

According to a complementary characteristic, the sliding of the upper support wall(s) in relationship to the lateral holding wall(s) is commanded by a closing organ solidly attached to the rear retention mans, said closing organ can comprise at least one cable and the rear retention means, constituted by a belt, forming a retention buckle, which is adjustable due to adjustment and locking means.

In the preferred embodiment, the lateral holding walls have each a rear connection extension, fitted with a longitudinal hole, in which slides a traction tenon, which allows the closing organ to be firmly attached to the rear retention means.

In addition, according to an added feature, the holding wall unit forming the cavity is constituted, in part, by walls of flexible or deformable material.

According to another characteristic, the front retention means comprise positioning means to permit, prior to being put into place, the retaining of the rear retention buckle in a position similar to the gripping position which it occupies once installed around the rear extremity of the shoe.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 7*a* is a transverse sectional view of a front extremity illustrating the cavity of the retention device for a larger boot or shoe;

FIG. 7*b* is a detailed illustration of a size adjusting mechanism for the front extremity;

FIG. 7*c* is a transverse section of the front extremity sized for a smaller shoe;

DETAILED DESCRIPTION OF THE PREFERRED EMBODIMENTS

The snow shoe which is to be equipped with the device according to the present invention can, of course, be of any type. An exemplary snow shoe is represented in FIGS. 1 and 2.

Figure 1:
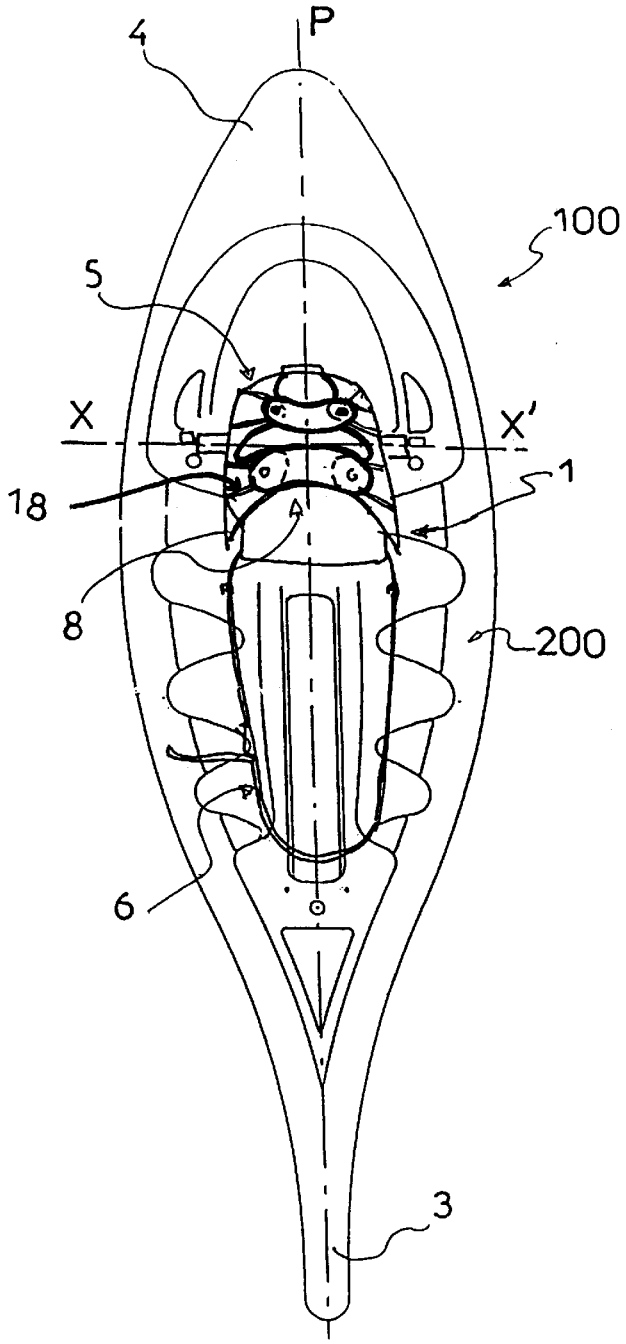
FIG. 1 is a top view of a snow shoe and a retention device in accordance with the present invention for retaining a shoe or boot on the snow shoe.
Figure 2:
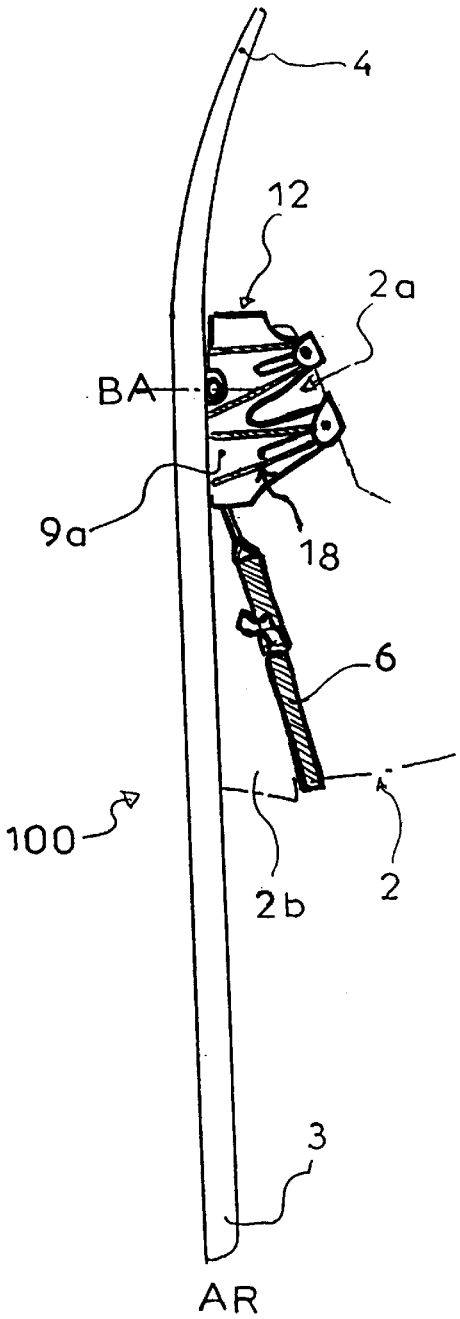
FIG. 2 is a side view of the snow shoe and retention device of FIG. 1.

As is illustrated in FIGS. 1 and 2, the snow shoe designated under general reference 100 is presented, for example, symmetric about a plane of symmetry P fixed below the shoe. A principal frame 200 which delimits an interior zone comprises a set of internal walls supporting the retention device, more commonly called binding 1, destined to retain the boot or shoe 2 of the user. Said principal frame has, for example, a generally elongated shape, with a tail 3 of reduced width extending to the rear, as well as a raised front with slightly pointed shape in order to constitute a front spatula 4. The snow shoe can, of course, also have any other shape, without going outside the scope of the invention.

The boot or shoe 2 of the user is retained at the snow shoe proper by the device according to the invention, bearing the general reference 1 and which is principally constituted by a front retention means 5 comprising a set of holding walls 9*a,* 9*b,* 10*a,* 10*b,* 11, 12, 13*a,* 13*b* forming an enclosure or cavity 8, open toward the rear, in which is engaged and retained a front extremity 2*a* of the shoe 2. Furthermore, a rear extremity or heel 2*b* of the shoe 2 is held by a rear retention means 6, the installation of which causes the cavity 8 to close on and/or around the front extremity 2*a* of the shoe 2. The boot or shoe is urged toward the front AV and into the front retention means 5 by a traction strap or member 21, passing behind the heel of said shoe, which constitutes the rear retention means 6 for the latter.

The traction device 21 forms a retention loop for the shoe and constitutes an extension for a tensioning agent 18 for contracting the cavity 8. This latter includes one or several cables 18*a,* 18*b* whose traction provokes the closing or contracting of the cavity 8 on the front extremity 2*a* of the shoe 2. A tensioning force is placed on the tensioning agent 18 by closing the rear retention means 6.

To that end, the traction member 21 is, for example, constituted by a strap or belt connected with and extending from the tensioning agent 18. The traction member includes a means for adjustment and locking 22 such as one or several adjustment and locking buckles 22*a,* 22*b*.

The contracting of the cavity 8 over the front extremity 2*a* of the shoe 2 thus takes place automatically with installation of the rear retention means 6.

Figure 3:
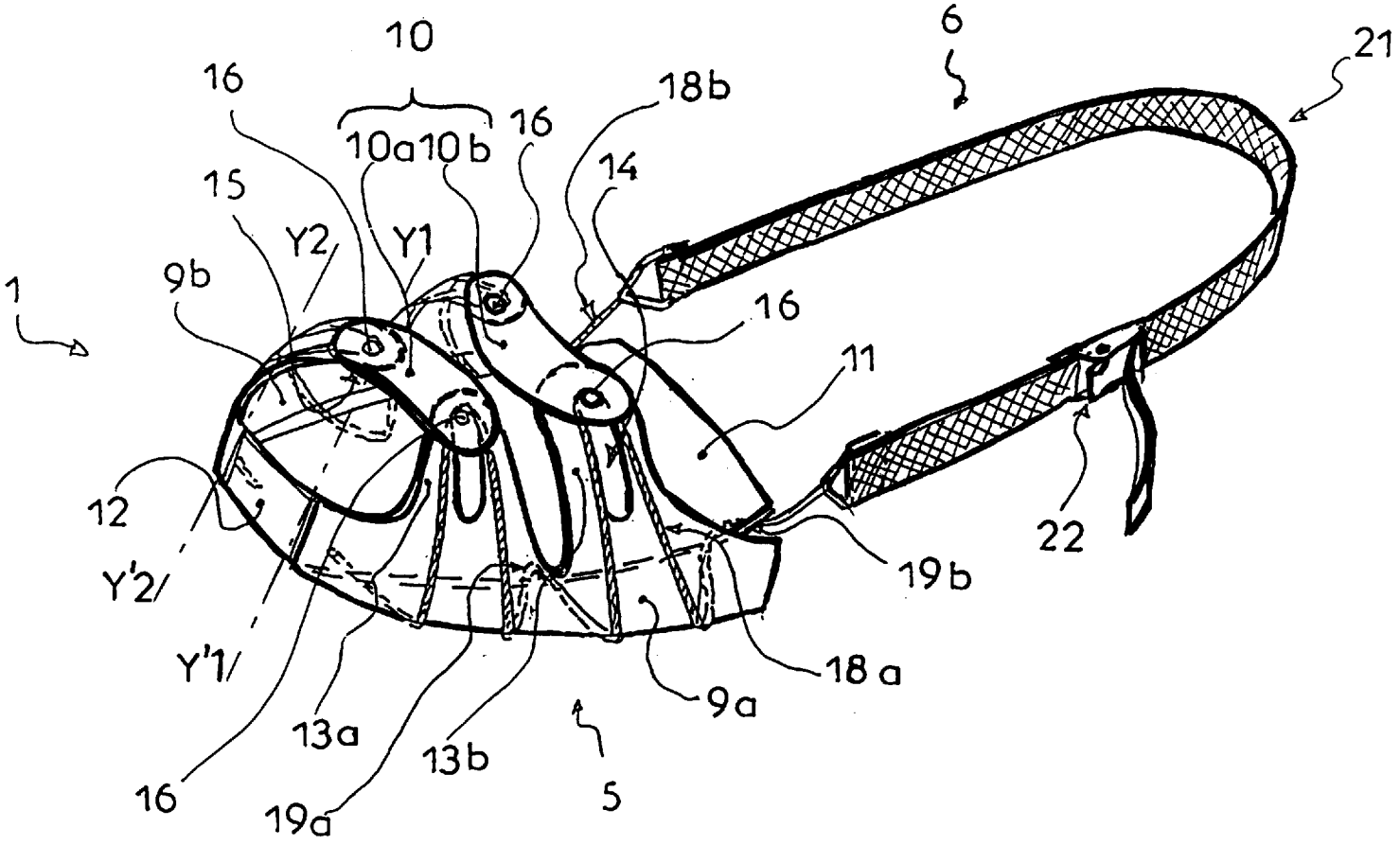
FIG. 3 is a perspective view of the retention device of FIG. 1.

According to a first specific embodiment of said device, the front retention means 5 are constituted by an enclosure or cavity 8, open toward the rear AR composed of two lateral holding walls 9*a,* 9*b,* beneficially linked between each other by upper connection means 10, by a lower wall called a sole plate 11, and a front stop wall 12 as illustrated in FIG. 3.

According to this first embodiment, the front stop wall 12 is an extension of the sole plate 11 of the retention device 1. Said sole plate 11 is mounted in a pivoting manner around an approximately transverse axis XX' of the snow shoe 100 or is fixed on an intermediary plate, pivoting according to XX' in a manner known per se. The lateral holding walls 9*a,* 9*b* arranged on all sides of the shoe 2 of the user, are each articulated relative to the front stop wall 12. It should be noted that said articulations beneficially occur according to the approximately vertical axes Y1Y'1 or Y2Y'2. According to this first specific embodiment, the lateral holding walls 9*a,* 9*b* are made of flexible or deformable, even slightly elastic material, and constitute extensions of said front stop wall 12. Thus, the articulation is obtained by folding or deformation. However, the articulation of the walls could be constituted by a hinge or by any other equivalent means, without going outside the protective domain claimed under the invention.

These articulations of the lateral holding walls 9*a,* 9*b* in relationship to said front stop wall 12 according to axes Y1Y'1 and Y2Y'2 permit them to be transversely pulled, one toward the other, at the closing of the cavity 8 around the front extremity 2*a* of the shoe 2.

Each lateral holding wall 9*a,* 9*b* comprises, in addition, two upper wall extensions 13*a,* 13*b* of rounded shape, directed toward the interior of the enclosure 8 and destined to spread out transversely above the front extremity 2*a* of the shoe 2. Furthermore, these upper wall extensions 13*a,* 13*b* are symmetrically arranged on all sides of the shoe 2 and are each fitted with a transverse, elongated slot 14.

An upper connection means 10 of this first embodiment are constituted by two upper support walls or strips 10*a,* 10*b,* that is to say, one front upper support wall or strip 10*a* and one rear upper support wall or strip 10*b,* arranged transversely between two upper extensions of the wall 13*a,* 13*b* symmetrically to lateral holding walls 9*a,* 9*b*.

These upper support strips 10*a,* 10*b* have at the extremities on their lower surfaces 15 gripping teeth 16 or gripping detents or gripping pins, which slide in the transverse slots 14 of the upper wall extensions 13*a,* 13*b* of the lateral holding walls 9*a,* 9*b*. The upper support strips 10*a,* 10*b* are pulled downwards BA while sliding toward the lateral holding walls 9*a,* 9*b* when the rear retention means 6 are put in place. Furthermore, these support strips 10*a,* 10*b* are beneficially rounded or convexly curved in shape in a manner so as to be able to superimpose themselves upon the upper extension of the wall 13*a* , 13*b* and thus facilitate the sliding of the gripping teeth 16 into the transverse holes.

The tensioning agent 18 controls the sliding of the pins 16 into the transverse slots 14 of the upper extensions 13*a,* 13*b*. More specifically to the first embodiment, two cables 18*a,* 18*b* are symmetrically arranged on both sides of the retention device 1. Each cable 18*a,* 18*b* is fixed on the front of the sole plate 11 or on the front stop wall 12 at one of its extremities. Each cable then passes on the outside of the lateral holding wall 9*a,* 9*b* and its upper wall extension 13*a* . It then twists around a first pin 16 while passing between the upper wall extension 13*a* and the lower surface 15 of the upper support strips 10*a,* 10*b* around said pin 16. It then passes through a return means 19*a* of the sole plate 11, prior to twisting in identical fashion to the second pin 16. Finally, it passes through another return means 19*b* of the sole plate 11 and attaches at its other end to the rear retention means 6. These rear retention means 6 are constituted by a traction or tensioning agent 21, formed by a retention belt 21, each end of which is attached to an extremity of one of the cables 18*a,* 18*b* of tensioning agent 18. In addition, these rear retention means 6 includes means of adjustment and locking 22 such as, for example, an adjustment and locking buckle 22 which permits varying the length of the belt or strap forming the loop 21. Thus, when the rear retention means 6 are put in place, the gripping action of the retention strap 21, thanks to the adjustment and locking means 22, pulls on the cables 18*a,* 18*b,* causing them to pull the pins 16 in downward direction BA sliding along the transverse slots 14 of the upper extensions of wall 13*a,* 13*b*. This downward sliding of the pins causes, thanks in part to the rounded shape of the upper support wall 13*a,* 13*b,* the transverse attraction of the lateral holding walls 9*a,* 9*b* toward one another. In this manner, the cavity 8 is contracted or closed around the front extremity 2*a* of the shoe 2.

In a second embodiment of the invention, illustrated in FIGS. 4, 5, 6, and 7, the retention device 1 includes front retention means 5 generally as previously described. A cavity 8 is formed by a sole plate 11, a front stop wall 12, two lateral holding walls 9*a,* 9*b* having two upper wall extensions 13*a,* 13*b* and two upper support walls or members 10*a,* 10*b* mounted in sliding fashion on said extensions.

Figure 4:
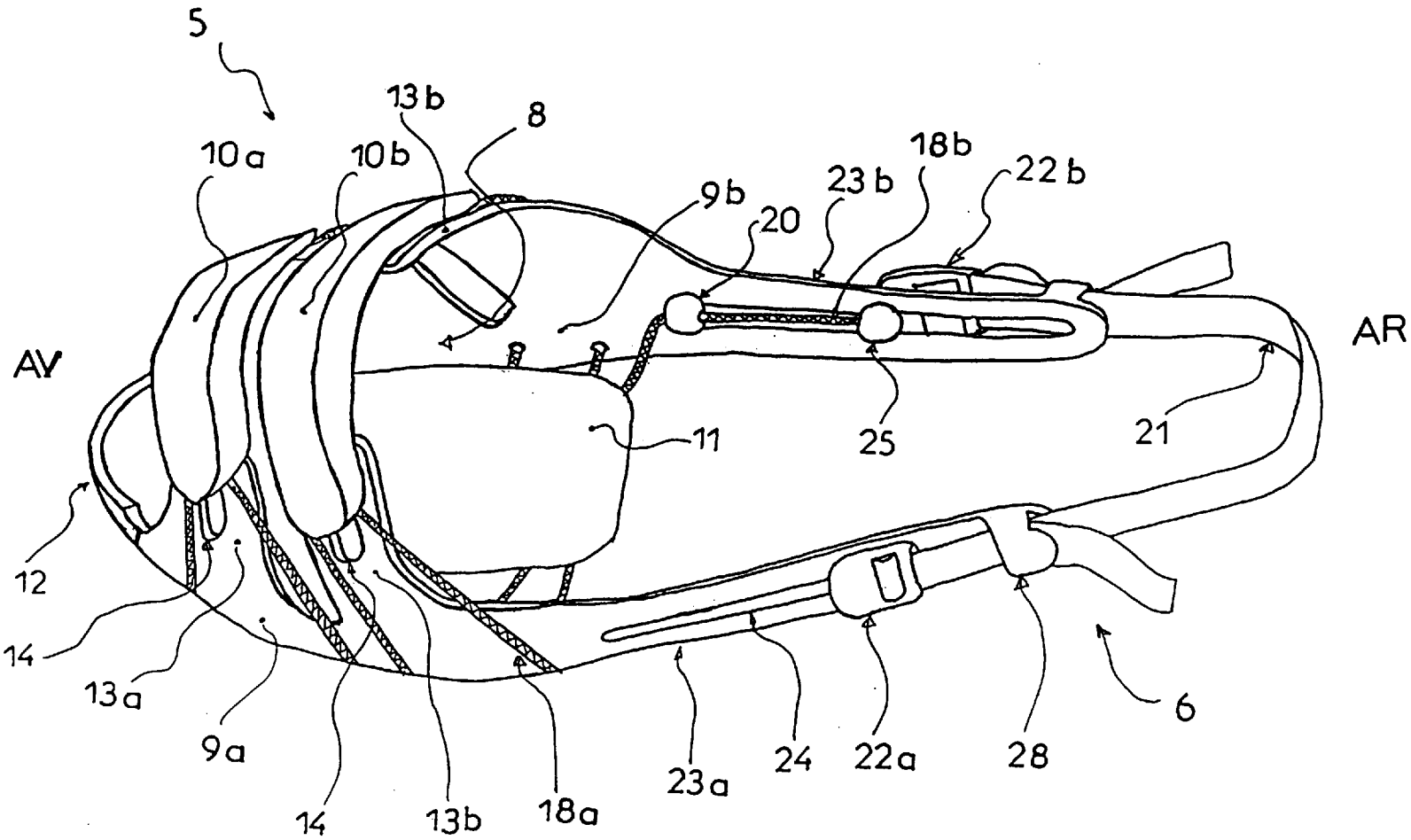
FIG. 4 is a perspective view of the retention device.

According to this second embodiment, the lateral holding walls 9*a,* 9*b,* each having a supplementary wall extension called rear connection extension 23*a,* 23*b* which extends longitudinally to the rear AR and which is fitted with a longitudinal hole or slot 24 into which a traction tooth, detent, or pin 25 slides under action of the traction agent 21 of the rear retention means 6, as demonstrated in FIG. 4. In addition, the two pins 25 are each fixed to one end of one of the cables 18*a,* 18*b* of the tensioning agent 18 as well as to one of the extremities of the retention belt 21 forming the rear retention means 6.

Figure 6:
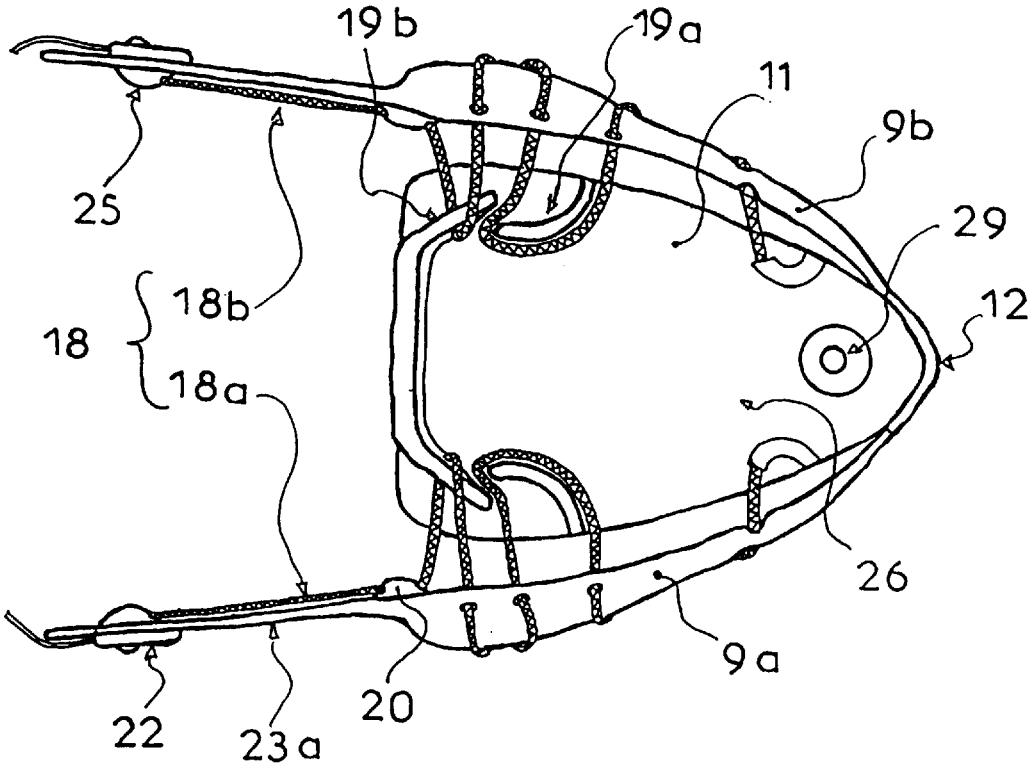
FIG. 6 is a bottom view of this retention device.

According to the second embodiment, the cables 18*a,* 18*b* follow a path almost identical to that of the first embodiment. A final return means or guide 20 is situated on the lateral holding walls 9*a,* 9*b* and is arranged approximately in the extension of the longitudinal slot 24 of the rear connection extension 23*a* 23*b* perpendicularly to the upper wall extension 13*b* situated further in the rear, as illustrated in FIGS. 4 and 6. The return means 19*a,* 19*b,* 20 of the sole plate 11 can be constituted, for example, either by semi-circular or semi-spherical, molded passages on the lower surface 26 of the sole plate 11, or by passage holes arranged on an edge jutting out from below the sole plate 11 as is shown in FIG. 6.

According to the second embodiment, the rear retention means 6 have as adjustment and locking means 22 two lateral adjustment and closing buckles 22*a,* 22*b* solidly joined each to a traction detent 25 as shown in FIG. 4. The belt forming the retention loop 21 is firmly attached at each of its extremities to one of the adjustment and closing buckles 22*a,* 22*b* and passes, moreover, through a rear passage 28 located at the rear extremity of the connection extensions 23*a,* 23*b* prior to passing around the heel of the boot or shoe 2 of the user.

Figure 5:
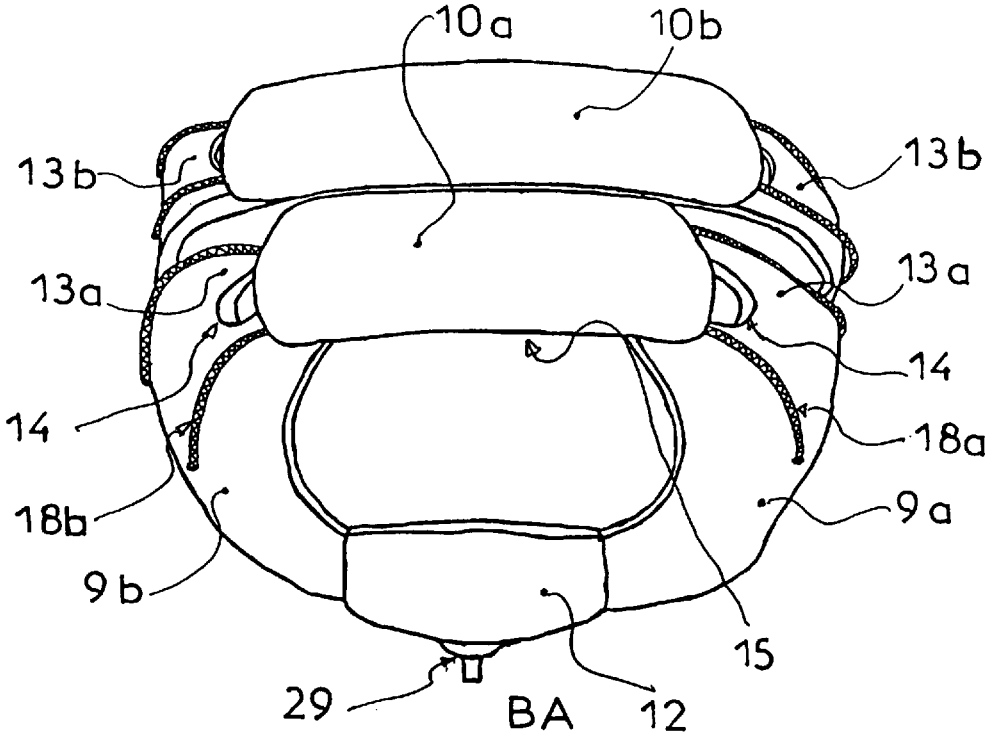
FIG. 5 is a front view of said retention device.

Furthermore, the sole plate 11 can beneficially be equipped on its lower surface 26 with a front spike or cleat 29 as shown in FIG. 5 or 6.

Thus, according to the second embodiment, at the time when the rear retention means 6 are put in place, the gripping of the retention belt 21 provokes sliding to the rear AR of the traction detents 25 along the longitudinal slots 24 toward the rear of the extensions 23*a,* 23*b* communicating the pulling or tensioning forces toward the front AV of the shoe 2. Said sliding allows traction on the cables 18*a,* 18*b,* forming the tensioning agent 18 to cause a displacement in the downward direction BA of the pins 16 of the upper support strips 10*a,* 10*b* along the transverse slots 14 of the upper wall extensions 13*a,* 13*b*. This displacement causes, due to the vertical articulation of the lateral holding walls 9*a,* 9*b,* a transverse drawing together of these, as well as downward displacement BA of the upper support straps 10*a,* 10*b* in a manner so as to contract the cavity 8 around the front extremity 2*a* of the shoe 2.

According to a variation, not shown, the tensioning agent 18 includes a single cable, whose ends are fixed to the two ends of the retention loop 21 of the rear retention means 6 by way of the detents 25 and the adjustment and closing buckles 22*a,* 22*b* . The path of the single cable is identical, with the exception that at the front, there is no cable fixation. Instead, the single cable extends through a return or passage means, beneficially situated on the front stop wall or below the front extremity of the sole plate.

According to another variation, the pins 16 are no longer arranged under the upper walls 10 or straps 10*a,* 10*b* in a manner so as to slide into the transverse slots 14 of the upper extensions of the wall 13*a,* 13*b* . Rather, the pins are fixedly mounted on the upper surface of said extensions 13*a,* 13*b* in such a manner so as to slide into a slot or a guide in the upper support wall or member 10*a* , 10*b* . Thus, the upper extensions of the wall 13*a,* 13*b* no longer have transverse slots. They have, beneficially, a smooth lower surface. In this embodiment, the cables 18*a* , 18*b* no longer attach directly to the pins 16. Instead, they are slidingly connected to the extremities of the upper support walls 10 or straps 10*a,* 10*b,* in a manner so as to be able to pull said upper support straps in the downward direction BA when the rear retention means 6 are pulled into place.

Thus, according to these embodiments and their variations, the lateral holding walls 9*a,* 9*b* are articulated, by pivoting on the front stop wall 12 around approximately vertical axes Y1Y'1 and Y2Y'2 in a manner as to pivot the one toward the other in an orthogonal horizontal plane to said axes when the rear retention means 6 are put in place.

Figure 8:
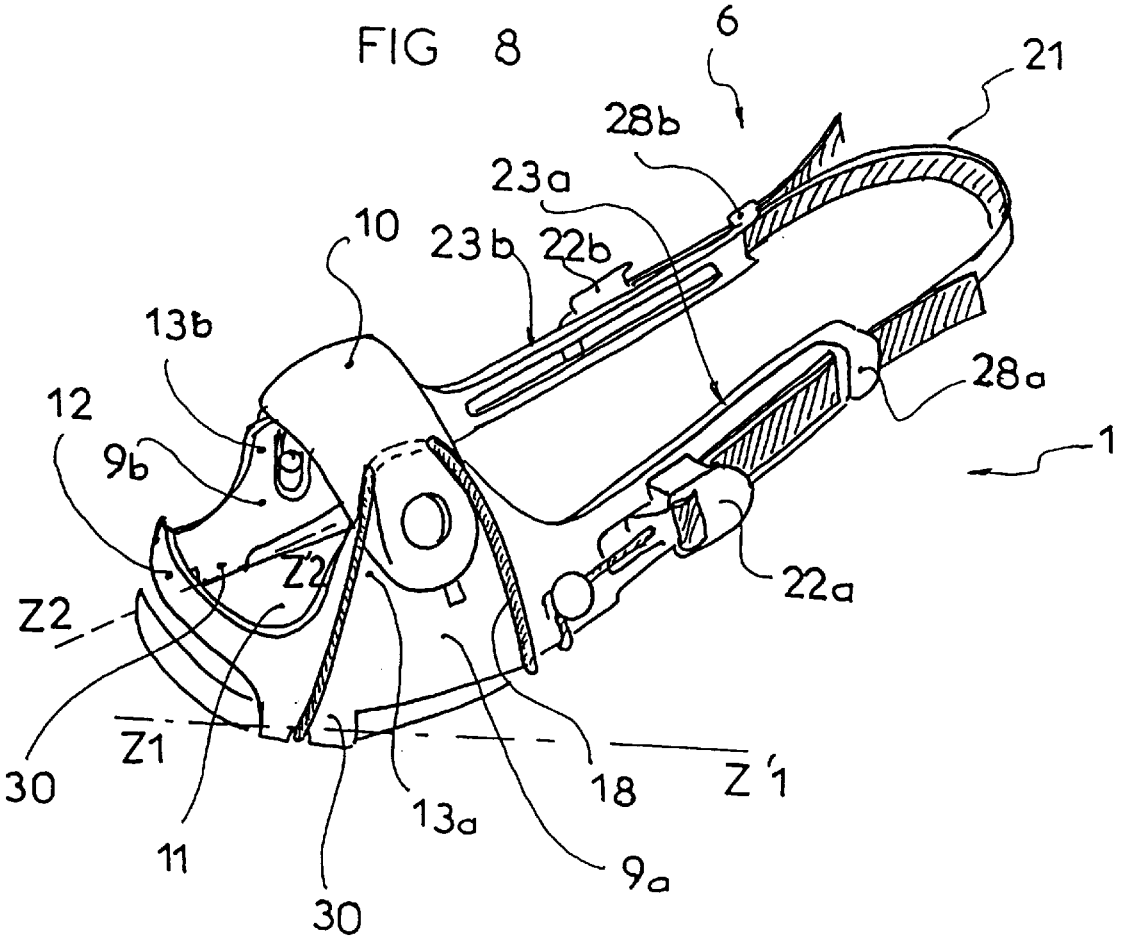
FIG. 8 is a perspective view, showing another specific embodiment.

According to a third preferred embodiment illustrated in FIG. 8, only one of the lateral holding walls is fitted with an upper wall extension 13*a,* 13*b* . One upper support wall or strap 10 is mounted in sliding fashion on said extensions. Sliding takes place in an identical manner as the preceding embodiments. Moreover, the front stop wall 12 is constituted by a connecting extension of the lateral holding walls.

The retention device 1 has, as in the preceding embodiments, a tensioning agent 18 including cables, whose ends are solidly joined with the rear retention loop 21 on the one side, and the upper support wall 10 on the other side, in such a manner so as to permit the contracting of the cavity over the front extremity 2*a* of the shoe 2 when said rear retention buckle is put into place.

According to this third preferred embodiment, the lateral holding walls 9*a,* 9*b* are articulated by pivoting on the sole plate 11 around two axes Z1Z'1 and Z2Z'2, beneficially located in a horizontal plane. The lateral holding walls 9*a,* 9*b* can be constituted by an extension of the sole plate 11 or be fixed to the same by a fixation sling 30. Said sling is formed by an extension of the lateral holding walls and defines a connection means between the sole and the lateral walls. Thus, articulation takes place, for example, by folding or deformation in length of a portion of the line or axis of said means of connection. It should be noted that in the preferred mode, as illustrated, the fixation slings 30 are extension in downward direction of the lateral walls.

According to this third embodiment, the connection means are positioned approximately toward the front AV of the sole. It goes without saying that said means of connection could also be positioned toward the rear, without consequently going beyond the field of protection of the invention. It should, in addition, be noted that the pivotal axes Z1Z'1 and Z2Z'2 come together at a point situated in front of the retention device 1. However, depending upon the longitudinal position of the connection means said axes could, for example, extend parallel in the plane of the general symmetry P. It should be noted that, beneficially, the fixation slings are connections realized of flexible material.

According to this embodiment, when the rear retention means 6 are put in place, the lateral holding walls 9*a,* 9*b* are pulled, through pivotal movement toward the sole plate 11, around the approximately longitudinal axes Z1Z'1 and Z2Z'2 situated in the horizontal plane of the sole plate. As a result, the lateral holding walls are each pulled through pivotal movement into a vertical orthogonal plane to said axes.

Moreover, the front retention means 5 which include a positioning means of the rear retention loop 21 in such manner that they permit said loop to be held in an approximately horizontal place, situated slightly above the plane of the sole plate when the retention device 1 is in an inactive position, that is to say, prior to said loop being put into place, when it does not hold shoes. Said positioning means thus permits placement of the retention loop 21 around the heels of the shoe, with assistance from the adjustment buckles 22*a,* 22*b* in maintaining the buckle in approximately similar position to its position of gripping, once put into place against the heel of the shoe. According to this embodiment, said positioning means are formed by means of rigid passages 28*a,* 28*b* beneficially situated at the extremity of the rear connection extensions 23*a,* 23*b* of the lateral holding walls 9*a,* 9*b* . Said passages permit the holding of the semi-rigid belt, forming the retention loop 21.

Figure 9:
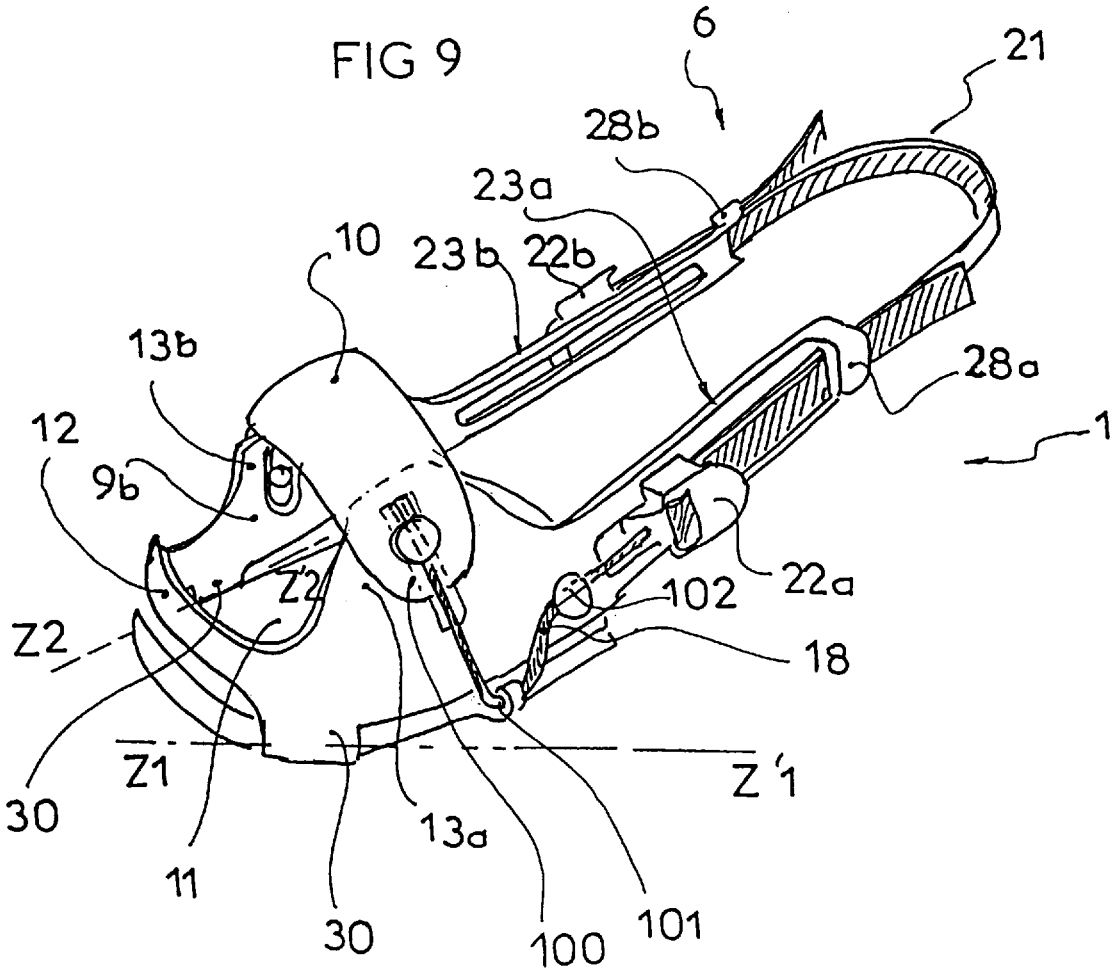
FIG. 9 is a perspective view, showing yet another specific embodiment.

According to a fourth embodiment illustrated in FIG. 9, the retention device 1 has a front means 5 substantially as described in the third embodiment. An upper support wall or strap 10 is mounted in sliding fashion on the extensions of the upper walls 13*a,* 13*b* of the lateral holding walls, thanks to the detents. According to this embodiment, the tensioning agent 18 is constituted by two cables 18*a,* 18*b* whose paths, somewhat identical for each of them, differ from the path of the preceding embodiments. One end of the cable is fixed on the upper support wall or strap 10 closely to its respective lateral end 100. The cable then passes through a lateral return point or guide 101 constituted, for example, by means of a passage hole situated in a lateral extension of the sole plate 11, extending in an upward direction over the length of the lateral holding walls. The cable then passes through a return means 102 arranged on the lateral holding walls in a manner so as to return the cable toward the adjustment buckle 22*a,* 22*b* of the retention loop 21 and is fixated thereto.

According to a fifth embodiment not illustrated, the front retention means are constituted by the two lateral holding walls and the sole plate. Said lateral holding walls are articulated by folding the length of the line forming the intersection of same with the sole plate. One of the two lateral holding walls includes an upper wall extension intended to pass above the front extremity of the shoe in order to be mounted in sliding fashion on the other lateral wall. A tensioning agent, solidly attached to the rear retention means permits the control of this sliding and thus the closing of the cavity around the shoe.

Likewise, another variation includes realizing the cavity by utilizing an envelope or sheet of flexible material, with its edges lapping in a sliding relationship, for example the one relative to the other below the sole plate. By mutually covering each other, said sliding is directed by the tensioning agent which is solidly connected with the rear retention means.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A binding for retaining a boot or shoe which has a toe and a heel on a snow shoe, the binding comprising:

a front retention means for defining a cavity with a rearward opening, the cavity dimensioned for receiving the toe, the front retention means including:

a lower surface, at least two lateral side walls extending upward from the lower surface, an upper connection means for connecting upper ends of the side walls, and, a front stop wall, the side walls being articulately connected to the front stop wall for articulation relative to generally vertical axes;

a rear retention means extending rearward from the front retention means for retaining the heel; and, a contracting means for contracting the cavity defined by the front retention means, the contracting means being connected with the rear retention means such that retaining the heel causes the contracting means to contract the front retaining means around the toe.

2. The binding as set forth in claim 1 wherein the side walls are articulated relative to the lower surface.

3. The binding as set forth in claim 1 wherein the upper connection means includes:

a member connected between the side walls in a sliding relationship with at least one of the side walls.

4. A binding for retaining a boot or shoe which has a toe and a heel on a snow shoe, the binding comprising:

a front retention means for defining a cavity with a rearward opening, the cavity dimensioned for receiving the toe, the front retention means including:

a lower plate, at least two lateral side walls extending upward from the lower plate, and, a member connected between the side walls in a sliding relationship with at least one of the side walls, the member being concave in a downward direction such that the side walls draw inward toward each other as the concave member slides along the side walls;

a rear retention means extending rearward from the front retention means for retaining the heel; and, a contracting means for contracting the cavity defined by the front retention means, the contracting means being connected with the rear retention means and the concave member such that retaining the heel causes the contracting means to draw the side walls inward contracting the front retaining means around the toe.

5. The binding as set forth in claim 4 wherein the side walls each include at least one upper wall extension which defines a transverse slot therein, the member being slidably mounted between the two extensions and further including detents connected with opposite ends of the member, the detents being slidably received in the transverse slots of the extensions.

6. A binding for retaining a boot or shoe which has a toe and a heel on a snow shoe, the binding comprising:

a front retention means for defining a cavity with a rearward opening, the cavity dimensioned for receiving the toe, the front retention means including:

a lower plate, at least two lateral side walls extending upward from the lower plate, and, a member slidably connecting upper portions of the side walls;

a rear retention means extending rearward from the front retention means for retaining the heel; and, a contracting means connected with the member for causing the member to slide relative to the side walls drawing the upper portions of the side walls toward each other when the retaining means retains the heel.

7. The binding as set forth in claim 6 wherein the contracting means includes at least one cable.

8. The binding as set forth in claim 7 wherein the side walls each have a rearward extension having a longitudinal slot therein, the rear retention means having detents which are slidably received in the longitudinal slot.

9. The binding as set forth in claim 8 wherein the rear retention means includes a belt which forms a loop for extending around the heel and a means for adjusting a length of the loop.

10. The binding as set forth in claim 9 wherein the front retention means includes a positioning means which holds the loop in an approximately similar position as when placed around the heel.

11. A binding for snow shoes comprising:

a front binding portion including a lower portion, a pair of flexible side walls extending upward from opposite sides of the base portion, an upper wall portion slidably connected across an upper portion of the side walls such that the base portion, the side walls, and the upper wall portion define a cavity for receiving a toe of a boot or shoe;

a strap extending rearwardly from the side walls for engaging a heel of the boot or shoe;

at least one cable connected with the strap, the cable extending through guides on the front binding portion and engaging the upper wall portion such that as the strap is pulled over the heel, the strap pulls the at least one cable and the at least one cable causes the top wall portion to slide further over the upper portions of the side walls drawing the side walls together contracting the cavity within which the toe is received.

* * * * *